United States Patent [19]

Nishioka

[11] 4,261,321

[45] Apr. 14, 1981

[54] BOW AND ASSEMBLY FOR PROPELLING PROJECTILE WITH MOVING FLUID ASSOCIATED THEREWITH

[76] Inventor: Jim Z. Nishioka, 1268 Hemlock NW., Salem, Oreg. 97304

[21] Appl. No.: 32,225

[22] Filed: Apr. 23, 1979

[51] Int. Cl.[3] ..... F41B 11/00; F41B 5/00

[52] U.S. Cl. ..... 124/67; 124/25; 124/83

[58] Field of Search ..... 272/140; 124/25, 41 C, 124/61, 65, 66, 67, 68, 71, 73, 74, 75, 76, 82, 83

[56] References Cited

U.S. PATENT DOCUMENTS

| | | | |
|---|---|---|---|
| 2,069,821 | 2/1937 | Douglas | 124/67 |
| 2,214,224 | 9/1940 | Douglas | 124/67 |
| 2,604,088 | 7/1952 | Wells | 124/67 |
| 2,821,394 | 1/1958 | Barbeau | 272/140 X |
| 3,640,263 | 2/1972 | Rhodes | 124/75 |

FOREIGN PATENT DOCUMENTS

| | | | |
|---|---|---|---|
| 2459310 | 6/1976 | Fed. Rep. of Germany | 124/25 |

*Primary Examiner*—Richard T. Stouffer

[57] ABSTRACT

A projectile propelling assembly for use with a bow includes an elongated guide member for guiding a projectile to be shot by the bow. The guide member is mounted on the bow by a support and in its mounted position the guide member extends longitudinally in the direction of the shooting motion of the bowstring. In one embodiment of the invention the tension for the bow is provided by a spring, and in another embodiment, a pair of flexible bow arms is employed. A channel is provided for movement of a fluid and is operatively associated with the guide member. The bowstring is operatively associated with the tension source of the bow, the channel, and the guide member. The drawing movement of the bowstring increases the tension in the bow and when the bowstring is released, the tension of the bow acts on the fluid which in turn acts on the projectile to propel it from the bow. In one embodiment of the invention, when the bowstring is drawn into a drawn condition and then released, the bowstring is under no load and does not propel the projectile as it returns to an undrawn condition.

2 Claims, 8 Drawing Figures

BOW AND ASSEMBLY FOR PROPELLING PROJECTILE WITH MOVING FLUID ASSOCIATED THEREWITH

BACKGROUND OF THE INVENTION

This invention relates to new and useful improvements in archery bows and is particularly concerned with projectile propelling assemblies for bows wherein the projectiles are propelled by fluid.

SUMMARY OF THE INVENTION

According to the present invention and forming a primary objective thereof a projectile propelling assembly for archery bows is provided that is simplified in construction and at the same time has combined features which utilize an arrangement of a bowstring, a tension means, a guide member, a fluid, and a channel for the fluid wherein the projectile is propelled from the bow by the fluid.

In carrying out these objectives, the bowstring is operatively associated with the tension means, the channel and the guide member so that when the bowstring is drawn and released, the tension of the bow will cause movement of the fluid from the channel into the guide member where it acts on the projectile to propel it from the bow.

In one embodiment of the invention the guide member, the bowstring and the projectile are arranged such that the user draws only the bowstring during the drawing movements of the bow, thus preventing finger pinching by the bowstring and the projectile. This adds to the accuracy of the user as well as making shooting more enjoyable.

The tension means, such as a spring shown in one embodiment of the invention and a pair of flexible bow arms shown in another embodiment, provide tension in the bow to propel the projectile. The projectiles may be a variety of designs such as BBs and pellets which are readily available and inexpensive to use.

An eccentric means also is provided for causing the tension in the bowstring to ease in end drawing movements of the bow. A fluid release means is employed to allow the user to load and draw the bow into a drawn condition and then relax the bow to an undrawn condition without propelling the projectile from the bow.

A projectile loading means is provided to allow loading of the projectile through an aperture in the guide member. In open position, the loading means exposes the aperture for loading and in closed position seals the aperture closed.

The fluid propelling means includes a channel which is operatively associated with the guide member for movement of the fluid into the guide member during shooting movements of the bow. The fluid propelling means also includes a device, such as a piston, which is disposed in the channel for moving the fluid during shooting motions of the bow.

The projectile propelling assembly includes positioning means for positioning the fluid propelling means on the bow in different locations.

A bow is shown wherein the guide member and the projectile remain stationary relative to the bow frame during drawing motions of the bow. There also is shown a bow which employs a bowstring which does not engage the projectile or guide member during shooting movements of the bow, thus eliminating the need to align the bowstring, the projectile and the guide member.

The use of fluid propelling means has the important advantage of allowing changes in direction of the propelling force, thereby permitting greater flexibility in bow designs. The fluid propelling means also allows use of a shorter guide member for compact, easy handling. Leverage of the tensioning means on the projectile can be varied by changing the length of the power stroke of the piston or changing the size of the piston or projectile.

The projectile propelling assembly may be added to conventional bows or incorporated into the bows during manufacture thereof.

The invention will be better understood and additional objects and advantages will become apparent from the following description taken in connection with the accompanying drawings.

DETAILED DESCRIPTION OF PREFERRED EMBODIMENTS

Figures 1, 2, 3, 4, 5, 6, 7, 8:
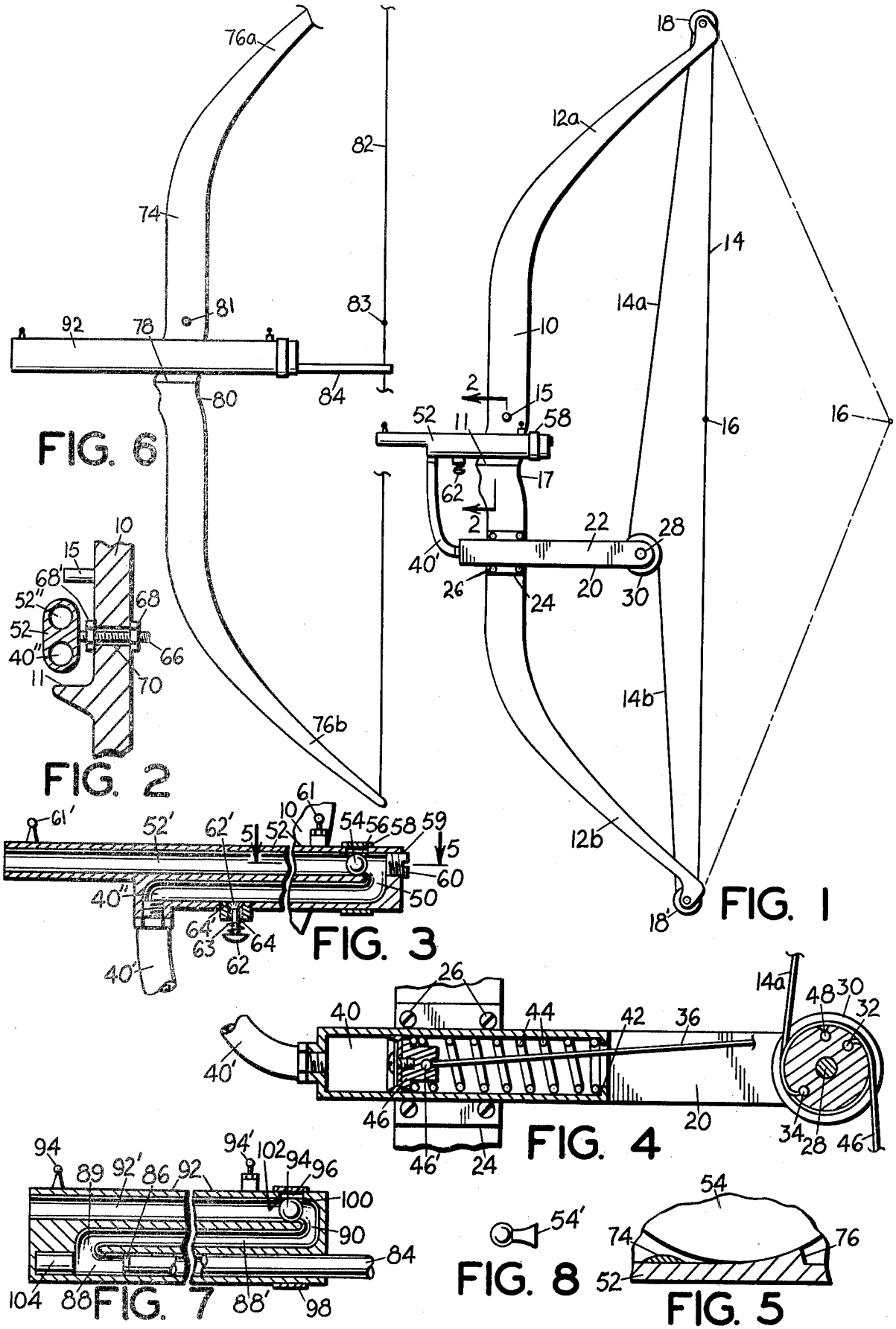
FIG. 1 is a side elevational view of a first form of the projectile propellinng assembly embodying the principles of the present invention.
FIG. 2 is an enlarged fragmentary sectional view taken or lines 2—2 of FIG. 1.
FIG. 3 is a foreshortened enlarged fragmentary sectional view of the guide member of FIG. 1, partly broken away.
FIG. 4 is an enlarged fragmentary sectional view of FIG. 1, partly broken away.
FIG. 5 is an enlarged fragmentary sectional view taken on lines 5—5 of FIG. 3.
FIG. 6 is a fragmentary elevational side view of a projectile shooting archery bow employing a modification of the invention.
FIG. 7 is a foreshortened enlarged fragmentary sectional view of the guide member of FIG. 6, partly broken away.
FIG. 8 is a side elevational view of a projectile.

With particular reference to the drawings and first to FIGS. 1 through 5, there is shown a conventional archery bow having a frame portion 10, an arrow shelf 11, bow arms **12*a* and 12*b* which extend from the frame portion, a bowstring 14 having end portions 14*a* and 14*b*, an arrow rest 15, bowstring mid portion or nocking point 16, and a hand grip 17**.

The projectile propelling assemblies of the present invention are designed for use with archery bows as shown, and it is to be understood that it could be used with other types of bows. The assemblies may be added to the bows or be an integral part of the bows.

An arm 20 is secured to the frame portion by mounting plate 24 and bolts 26. The spacing of these bolts is such that the arm 20 can be mounted vertically if desired. The arm extends rearwardly, namely towards the bowstring and has a bifurcated end 22 with a cross shaft 28 secured therein which supports a control or double pulley 30.

FIG. 1 shows an undrawn condition of the bow and a drawn condition of the bow in broken lines. The upper bowstring end portions **14*a* wraps around the guide member pulley 18 on the upper bow arm 12*a* and then engages the left side of the control pulley 30 and wraps around the control pulley in a counter-clockwise direction and is anchored on the pulley by anchor pin 32. The lower bowstring end portion 14b wraps around the guide member pulley 18' on the lower bow arm 12b and the engages the control pulley 30 from the right side and wraps around the control pulley in a counterclockwise direction and is anchored to the pulley by anchor pin 34**.

Cylindrical channel 40, FIG. 4, slidably supports a piston device 46. An inwardly extending ridge 42 and a tension spring 44 are also disposed in the cylindrical channel.

A connecting link 36 is connected to the piston device by a bore 46' and to the control pulley by an anchor pin 48 and thereby forms a connecting link between the piston device and the control pulley. Tension in the connecting link urges the piston device against the tension spring and causes the tension spring to engage the inwardly extending ridge 42. A flexible channel 40' connects the cylindrical channel 40 to a rigid channel 40'', FIG. 3. Since the flexible channel 40' is of flexible construction it can engage the rearward end of the guide member or housing 52, such as in the end plug aperture 59, if so desired, and by-pass the rigid channel 40''.

The guide member or housing 52 includes guide member bore 52'. The rigid channel 40'' is connected to the guide member bore 52' by a connecting aperture 50 which allows free passage of fluid, such as the air in this embodiment.

A projectile 54 is shown in loaded position in the guide member bore 52', the bore guiding the projectile when it is shot from the bow.

A loading aperture 56 is provided for loading the projectile into the guide member bore 52'. A sliding cover 58 is also provided and in open condition, exposes the loading aperture for loading the projectile and in a closed condition, seals the aperture closed so that during the shooting motions of the bow, the fluid will not escape through the aperture. An end plug 60 is disposed in the aperture 59 and is provided for cleaning and servicing the guide member and can also receive the flexible channel 40' to eliminate the rigid channel 40'', if so desired. An adjustable sighting means 61 and 61' are also provided for accurate shooting of the bow.

A fluid release means includes a shaft 62, spring 63 and a release aperture 64 which extends into channel 40''. The shaft 62 has a beveled enlargement 62' on the inner end thereof which corresponds with the beveled portion 64' of the release aperture 64 to form a seal in non-use condition of the fluid release means to prevent escape of fluid during the shooting motions of the bow.

With reference to FIG. 2 a support means comprising a support structure for the guide member is shown and includes a cross bolt 66 with double locking nuts 68 and 68' and a bore 70 extending transversely through the frame portion of the bow. The bore 70 is intentionally oversized for a purpose to be described later.

FIG. 5 shows a rigid ridge portion 76 extending inwardly in the guide member bore 52' and is designed to stop rearward movement of a loaded projectile. A resilient ridge portion 74 also extends inwardly in the guide member bore and is positioned in front of the loaded projectile. It is designed to impede incidental forward movement of the projectile and hold the projectile in proper loaded position until the bow is shot. The resilient ridge 74 is designed to readily yield when the bow is shot and therefore will not adversely affect the speed of the projectile.

In the operation of this form of the invention, the sliding cover 58 is opened and a projectile is loaded into the guide member bore 52' through loading aperture 56. The projectile is held in loaded position by the rigid ridge portion 76 and the resilient ridge portion 74. While the loading aperture provides a convenient means to load the projectile, the projectile can also be loaded into the front of the bore 52'.

The bowstring is operatively associated with the tension spring 44, control pulley 30, connecting link 36, and piston device 46. A drawing movement on the bowstring at the bowstring mid portion 16 causes the control pulley 30 to rotate in a clockwise direction which shortens the connecting link 36, urges the piston device against the tension spring 44 and compresses the tension spring to cause a tension buildup in the bow. As the control pulley rotates, the connecting link 36 moves closer to shaft 28 and this movement of the connecting link towards the shaft acts as an eccentric which causes a breakover in the bow to ease the tension in the bowstring in end drawing movements of the bow.

The fluid for this embodiment is the air in the cylindrical channel 40, the flexible channel 40' and the rigid channel 40'' and is operatively associated with the bowstring, the control pulley 30, the connecting link 36, the piston device 46, the tension spring 44, and the guide member bore 52' of the guide member 52. When the bow is in a drawn condition and the bowstring is released, the tension spring acts on the piston and drives it forcefully forward. This causes a rapid movement of the fluid in the cylindrical channel, the flexible channel and the rigid channel. Air from the rigid channel is forced through the connecting aperture 50 into the guide member bore 52' and against the projectile and thereby forcefully propelling the projectiles from the bow.

During drawing movements of the bowstring the user grips only the bowstring. The projectile and the guide member do not engage the bowstring or move during the drawing movements of the bowstring. When the bowstring is drawn into a drawn condition and then released, there is no load on the bowstring as it returns to an undrawn condition. This eliminates the possibility of the bowstring pinching the fingers against a projectile or the guide member and also eliminates the problems of poor arrow release and the need to select the proper arrow spline and length.

The drawing movement of the bowstring nocking point is greater than the power stroke of the piston 46 thus resulting in a more forceful power stroke of the piston 46.

Adjusting the windage and elevation angulation of the guide member is accomplished by loosening double nuts 68 and 68' and then re-tightening the nuts when the guide member is in desired setting. Transverse bore 70 which extends through the bow frame is intentionally oversized to allow vertical movement of the cross bolt 66 to accomplish the elevation adjustment. Windage adjustment is accomplished by the positioning of the double nuts 68 and 68' on the cross bolt 66.

The fluid release means allows the user to draw the bow into a drawn condition, then if desired, relax the bow into an undrawn condition without propelling the projectile from the bow. This is accomplished by depressing shaft 62 which opens the release aperture 64 to allow the fluid to escape from the channel as the bow is relaxed, thus preventing build-up of fluid pressure in the channel. In non-use condition of the fluid release means, the release aperture is sealed closed by the action of the spring 63 urging the shaft downward and mating the beveled enlarged portion of the shaft to the beveled portion of the aperture.

The projectile propelling assembly is arranged so that the bow can be used with conventional arrows and shot in the conventional manner without removing the projectile propelling assembly from the bow. For this purpose a nocking point or mid portion 16 and an arrow rest 15 are provided. Tension spring 44 provides the tension for the bowstring to propel the arrow. A projectile can be loaded and shot simultaneously with the arrow if so desired.

With reference to FIGS. 6 and 7 there is shown a conventional archery bow for use with the projectile propelling assembly of the present invention, the archery bow having a frame portion 74, bow arms 76*a* and 76*b*, an arrow shelf 78, a hand grip 80, an arrow rest 81, and a bowstring 82 with a mid portion or nocking point 83. The bow arms are flexible in this embodiment and provide the tension means for the bow.

Referring to FIG. 7, cylindrical channel 88 slidably supports a piston device 86 and a portion of the shaft structure or piston shaft 84. The rearward end of the piston shaft engages the bowstring. The cylindrical channel 88 is connected to a rigid channel 88' by a connecting aperture 89, and the rigid channel is connected to the guide member bore 92' of the guide member or housing 92 by a connecting aperture 90.

A projectile 94 is shown in a loaded condition and is guided by the guide member bore when it is shot from the bow. The projectile is held in a loaded position by a rigid ridge portion 100 and resilient ridge portion 102 and the two ridge portions act on the projectile in a manner similar to that described in the embodiment shown in FIG. 5, that is, the ridges hold the projectile in loaded position until it is shot from the bow, the resilient ridge allowing the projectile to escape with minimal slowing of the projectile speed.

Sighting means 94 and 94' are provided for the assembly. A projectile loading aperture 96 and sliding cover 98 are employed and are constructed and function in a manner similar to the sliding cover 58 and loading aperture 56 shown in FIG. 3. The sliding cover 98 is opened to expose the loading aperture 96 to allow loading of a projectile into the guide member bore 92'. When the cover is closed, it seals the guide bore closed to prevent loss of the fluid through the aperture during shooting motions of the bow.

A buffer device, such as a piston buffer 104 shown, is employed in this embodiment and provices a means to slow the forward thrust of the piston device at the end of its shooting stroke. The buffer is shown as a cylindrical air chamber into which the piston moves at the end of its stroke and since the chamber is closed, it will have a cushioning and stopping influence on the piston device. Resilient means, such as a coil spring or soft resilient plastic may also be employed in the chamber.

In operation of this embodiment of the invention the sliding cover 98 is opened to expose aperture 96 to load a projectile 94 into the guide member bore 92'. The projectile is held in loaded position by rigid ridge portion 100 and resilient ridge portion 102. As the bowstring is drawn rearwardly, the piston device 86 and the piston shaft 84 which is engaged to the bowstring, move rearwardly with the bowstring. The rearward movement of the piston device and piston shaft, which is slidably supported in the cylindrical channel 88, causes the amount of the fluid in the cylindrical channel to increase as more of the piston shaft is withdrawn from the channel.

When the bowstring is released, the tension in the bowstring causes the piston shaft and the piston device to move forcefully forward and cause a rapid migration of the fluid in the cylindrical channel 88 and the rigid channel 88'. The fluid is forced from the rigid channel into the guide member bore 92' through the connecting aperture 90 and forcefully acts on the projectile thereby propelling it from the bow.

The projectile propelling assembly of this embodiment is also arranged so that conventional arrows may be employed. The piston shaft 84 is disengaged from the bowstring 82 and positioned forewardly to be free of the latter during the shooting motions of the bow. Nocking point 83 and arrow rest 81 are employed to shoot the arrows in the conventional manner.

It is to be understood that the forms of my invention herein shown and described are to be taken as preferred examples of the same and that various changes in the shape, size and arrangement of the parts may be resorted to without departing from the spirit of my invention, or the scope of the subjoined claims. Examples include, the size relationship of the piston devices 46 and 86 to the guide member bores 52' and 92' can be changed, that is, the piston devices can be smaller, the same size or larger than the guide member bores to obtain optimum performance; and the position of the channel relative to the guide member and the bow frame can be changed, such as the rigid channel 40'' which is shown below the guide member bore 52' can be positioned laterally of or above the guide member bore.

Having thus described my invention, I claim:

1. A combination arranged for use with a projectile, said combination comprising (a) a bow,
(b) a tension means, and
(c) a projectile propelling assembly,
(d) said bow comprising
(e) a frame portion,
(f) a pair of oppositely extending arms with tip ends on said frame portion,
(g) a bowstring extending between said tip ends and including an end portion, and
(h) a bowstring guide on one of said tip ends for movably guiding said bowstring,
(i) said tension means operatively connected to said bowstring and arranged to provide tension in said combination by a drawing movement of said bowstring,
(j) said assembly comprising
(k) an elongated guide member for guiding a projectile, said member positioned longitudinally in a direction of a shooting motion of said bowstring,
(l) guide means in said guide member for guiding a projectile,
(m) a piston device for moving fluid in said guide member, and
(n) a control means operatively connecting said bowstring end portion, said piston device and said tension means, said control means controlling movement of said end portion and said piston during shooting motions of said combination,
(o) said control means including an eccentric operatively connected to said tension means, said bowstring end portion and said piston device for controlling tension in said bowstring during shooting motions of said combination, (p) said eccentric comprising a rotatable member, said rotatable member having said end portion of said bowstring operatively attached thereto, whereby drawing movement of said bowstring causes rotation of said rotatable member, said eccentric further comprising a connecting link operatively attached at one end thereof to said rotatable member at a location on said rotatable member offset from the axis of rotation thereof, said connecting link operatively attached at the other end thereof to said piston device, whereby rotation of said rotatable member causes movement of said piston device, such that drawing movement of said bowstring causes motion of said piston device in one direction, said tension means acting on said piston device such that following release of said bowstring from its drawn position, said piston device is forcefully driven by said tension means in a direction opposite to said one direction for causing rapid movement of fluid in said guide member.

2. A combination for use with a projectile, said combination comprising (a) a bow, (b) a tension means, and (c) a projectile propelling assembly, (d) said bow comprising (e) a frame portion, (f) a pair of oppositely extending arms with tip ends on said frame portion, and (g) a bowstring extending between said tip ends, (h) said tension means operatively connected to said bowstring and arranged to provide tension in said combination by a drawing movement of said bowstring, (i) said assembly comprising (j) an elongated guide member for guiding a projectile, said guide member positioned longitudinally in a direction of a shooting motion of said bowstring, (k) guide means in said guide member for guiding a projectile, (l) a piston device for moving fluid in said guide member, said device operatively connected to said bowstring and said tension means, (m) a channel means for movement of fluid, said channel means operatively connecting said guide member and said piston device, said channel means being rigid and having a forward end and a rearward end, said piston device being in fluid connection to said channel means by a first connecting aperture at said forward end of said channel means, said guide member being in fluid connection at one end thereof to said channel means by a second connecting aperture at said rearward end of said channel means, said guide member extending forwardly from said one end thereof to an open end thereof from which projectiles are to be propelled forwardly from the bow by fluid moved by said piston device through said channel means and then through said guide member, said fluid being moved rapidly during propulsion of projectiles from said guide member, the direction of motion of fluid during such propulsion being reversed as it is directed from said piston device through said channel means and then through said guide member.

* * * * *